US010027036B2

(12) United States Patent
Schmidt et al.

(10) Patent No.: US 10,027,036 B2
(45) Date of Patent: Jul. 17, 2018

(54) ANTENNA ARRAY AND METHOD FOR SYNTHESIZING ANTENNA PATTERNS

(71) Applicant: Kathrein-Werke KG, Rosenheim (DE)

(72) Inventors: Georg Schmidt, Laichingen (DE); Martin Weckerle, Ulm (DE)

(73) Assignee: Kathrein-Werke KG, Rosenheim (DE)

( * ) Notice: Subject to any disclaimer, the term of this patent is extended or adjusted under 35 U.S.C. 154(b) by 0 days.

(21) Appl. No.: 14/486,300

(22) Filed: Sep. 15, 2014

(65) Prior Publication Data

US 2015/0249291 A1 Sep. 3, 2015

Related U.S. Application Data

(63) Continuation of application No. 13/016,417, filed on Jan. 28, 2011, now abandoned.

(51) Int. Cl.

| | |
|---|---|
| ***H01Q 21/00*** | (2006.01) |
| ***H01Q 1/24*** | (2006.01) |
| ***H01Q 3/28*** | (2006.01) |
| ***H01Q 3/30*** | (2006.01) |
| ***H01Q 21/06*** | (2006.01) |

(Continued)

(52) U.S. Cl.

CPC ..... *H01Q 21/0006* (2013.01); *H01Q 1/246* (2013.01); *H01Q 3/28* (2013.01); *H01Q 3/30* (2013.01); *H01Q 21/06* (2013.01); *H01Q 21/08* (2013.01); *H01Q 21/24* (2013.01)

(58) Field of Classification Search

USPC ..... 455/73; 342/368

See application file for complete search history.

(56) References Cited

U.S. PATENT DOCUMENTS 5,079,557 A * 1/1992 Hopwood ..... H01Q 21/0025 342/372

5,151,706 A * 9/1992 Roederer ..... H01Q 25/00 342/372

(Continued)

FOREIGN PATENT DOCUMENTS

| | | |
|---|---|---|
| CN | 101026267 | 8/2007 |
| EP | 1064697 | 3/2003 |

(Continued)

OTHER PUBLICATIONS

International Preliminary Report issued in PCT/EP12/51456 dated Aug. 8, 2013.

(Continued)

*Primary Examiner* — Nay A Maung
*Assistant Examiner* — Erica Fleming-Hall
(74) *Attorney, Agent, or Firm* — Stephen H. Eland; Dann, Dorfman, Herrell & Skillman

(57) ABSTRACT

An antenna array having a plurality of antenna elements is disclosed. The antenna array comprises: a plurality of transceiver modules; an active antenna element subset of the plurality of antenna elements, wherein the active antenna element subset comprises at least one active antenna element being actively coupled to an associated transceiver module of the plurality of transceiver modules; and at least one passively combined sub-array of at least two antenna elements of the plurality of antenna elements. A method for generating antenna patterns with the antenna array is also disclosed.

8 Claims, 9 Drawing Sheets

(51) Int. Cl.
*H01Q 21/08* (2006.01)
*H01Q 21/24* (2006.01)

(56) References Cited

U.S. PATENT DOCUMENTS 6,016,123 A * 1/2000 Barton ..... H01Q 1/246 342/373
6,252,542 B1 * 6/2001 Sikina ..... H01Q 3/267 342/174
6,384,781 B1 * 5/2002 Kautz ..... H01Q 3/267 342/174
7,081,851 B1 * 7/2006 Lewis ..... H01Q 21/06 342/372
8,385,305 B1 * 2/2013 Negus ..... H04W 76/025 370/310
8,467,363 B2 * 6/2013 Lea ..... H01Q 21/24 370/310
8,532,697 B2 * 9/2013 Pascolini ..... H03H 7/38 343/711
2002/0187812 A1 * 12/2002 Guo ..... H01Q 1/246 455/562.1
2004/0066352 A1 * 4/2004 Hoppenstein ..... H01Q 23/00 343/853
2004/0204109 A1 * 10/2004 Hoppenstein ..... H01Q 1/246 455/562.1
2005/0148370 A1 * 7/2005 Moldoveanu ..... H01Q 1/246 455/562.1
2008/0291087 A1 * 11/2008 Tietjen ..... G01S 7/03 342/372
2009/0103593 A1 * 4/2009 Bergamo ..... H04B 1/707 375/146
2009/0146904 A1 * 6/2009 Shi ..... H01Q 1/32 343/893
2010/0194629 A1 * 8/2010 Craig ..... H01Q 1/288 342/354
2010/0214170 A1 * 8/2010 Quan ..... H01Q 21/0025 342/374
2011/0006949 A1 * 1/2011 Webb ..... H01Q 3/267 342/372
2011/0150050 A1 * 6/2011 Trigui ..... H04B 7/0617 375/219
2011/0248796 A1 * 10/2011 Pozgay ..... G01S 13/4463 333/137
2012/0133569 A1 * 5/2012 Pivit ..... H01Q 1/246 343/844

FOREIGN PATENT DOCUMENTS

EP 2221924 8/2010
WO 98/11626 3/1998
WO 2010136099 12/2010

OTHER PUBLICATIONS

Boeringer et al, "Particle Swarm Optimization Versus Genetic Algorithms for Phased Array Synthesis", IEEE Transactions on Antennas and Propagation, vol. 52, No. 3, Mar. 2004, pp. 771-779.
Raab et al, "High Efficiency Linear Amplification by Dynamic Load Modulation" IEEE MTT S Digest, 2003, pp. 1717-1720.
Official Action issued in Chinese Application No. 201280006846.5 dated Aug. 7, 2014.

* cited by examiner

ANTENNA ARRAY AND METHOD FOR SYNTHESIZING ANTENNA PATTERNS

PRIORITY APPLICATIONS

This application is a continuation of U.S. patent application Ser. No. 13/016,417, filed Jan. 28, 2011. The entire disclosure of the foregoing application is hereby incorporated herein by reference.

FIELD OF THE INVENTION

The field of the invention relates to an active antenna array and a method for synthesizing antenna patterns of an active antenna array.

BACKGROUND OF THE INVENTION

The use of mobile communications networks has increased over the last decade. Operators of the mobile communications networks have increased the number of base stations in order to meet an increased demand for service by users of the mobile communications networks. The operators of the mobile communications network wish to reduce the running costs of the base station.

Nowadays active antenna arrays are used in the field of mobile communications networks in order to reduce power transmitted to a handset of a customer and thereby increase the efficiency of the base transceiver station. The base transceiver station has an antenna array connected to it by means of a fibre optics cable and a power cable. The antenna array typically comprises a plurality of antenna elements, which transceive a radio signal. The base transceiver station is coupled to a fixed line telecommunications network operated by one or more operators.

Typically the base transceiver station comprises a plurality of transmit paths and receive paths. Each of the transmit paths and receive paths are terminated by one of the antenna elements. The plurality of the antenna elements typically allows steering of a radio beam transmitted by the antenna array. The steering of the beam includes but is not limited to at least one of: detection of direction of arrival (DOA), beam forming, down tilting and beam diversity. These techniques of beam steering are well-known in the art.

The active antenna arrays typically used in mobile communications network are uniform linear arrays comprising a vertical column of antenna array elements. The active antenna array is typically mounted on a mast or tower. The active antenna array is coupled to the base transceiver station (BTS) by means of a fibre optics cable and a power cable.

Equipment at the base of the mast as well as the active antenna array mounted on the mast is configured to transmit and receive radio signals using protocols which are defined by communication standards. The communications standards typically define a plurality of channels or frequency bands useable for an uplink communication from the handset to the antenna array and base transceiver station as well as for a downlink communication from the base transceiver station to the subscriber device.

For example, the communication standards "Global System for Mobile Communications (GSM)" for mobile communications use different frequencies in different regions. In North America, GSM operates on the primary mobile communication bands 850 MHz and 1900 MHz. In Europe, Middle East and Asia most of the providers use 900 MHz and 1800 MHz bands. Other examples of communications standards include the UMTS standard or long term evolution (LTE) at 700 MHz (US) or 800 MHz (EU).

As technology evolves, the operators have expressed a desire for an active antenna product which is as small and cost-effective as possible. The antenna gain should be maximized without significant increase of antenna size and cost, and without significantly sacrificing the tilt range of the antenna.

PRIOR ART

FIGS. 1 and 2 show prior art solutions for antenna arrays. The passive antenna array 1000 of FIG. 1 comprises eight antenna elements 1001-1 through 1001-8, which are passively coupled by a passive feed network 1006. A fixed beam pattern may be adjusted by selecting static beam forming weights $v_1$, through $v_8$. In such a prior art passive antenna arrays, beam up-tilting or down-tilting can be achieved using either mechanical tilting (e.g. using a stepper-motor or servo-motor based system for remotely moving the passive antenna's system tilt angle, by physically moving the whole of the antenna itself) or by using a 'remote electrical tilt' (RET) system. Such a RET system typically utilizes motor-controlled phase shift elements to achieve a tilt of the beam formed from the radio signals. The phases of the antenna elements 1001-1 through 1001-8 can thereby be progressively shifted in relation to each other in order to modify the tilt of the antenna array 1000.

FIG. 2 shows a known active antenna array 2000, wherein each of eight antenna elements 2001-1 through 2001-8 is connected to its own transceiver element 2003-1 through 2003-8. The beam shape and tilt can be flexibly designed by dynamically adjusting the beam forming weights $w_1$ through $w_8$ at the respective transceiver elements 2003-1 through 2003-8.

SUMMARY OF THE INVENTION

According to one aspect of the present disclosure, an active antenna array is disclosed, which comprises a plurality of transceiver modules and an active antenna element subset of the plurality of antenna elements, wherein the active antenna element subset comprises at least one active antenna element being actively coupled to an associated transceiver module of the plurality of transceiver modules. The active antenna array further comprises at least one passively combined sub-array of at least two antenna elements of the plurality of antenna elements.

According to another aspect of the present disclosure, a method for generating antenna patterns with an antenna array having a plurality of antenna elements is disclosed, the method comprising: determining static phase relations for the antenna elements of at least one passively combined sub-array of at least two antenna elements of the plurality of antenna elements of the antenna array; determining dynamic beam forming parameters for an active antenna element subset of the plurality of antenna elements and for said at least one passively combined sub-array; and relaying a radio signal with an antenna pattern through the plurality of antenna elements based on the static phase relations and the dynamic beam forming parameters.

The term "active" or "actively" as used herein shall refer to comprising dynamically adaptable beam forming parameters. Analogously, "passive" or "passively" as used herein shall refer to comprising static phase relations.

DETAILED DESCRIPTION OF THE INVENTION

The invention will now be described on the basis of the drawings. It will be understood that the embodiments and aspects of the invention described herein are only examples and do not limit the protective scope of the claims in any way. The invention is defined by the claims and their equivalents. It will be understood that features of one aspect or embodiment of the invention can be combined with a feature of a different aspect or aspects and/or embodiments of the invention.

Figure 1:
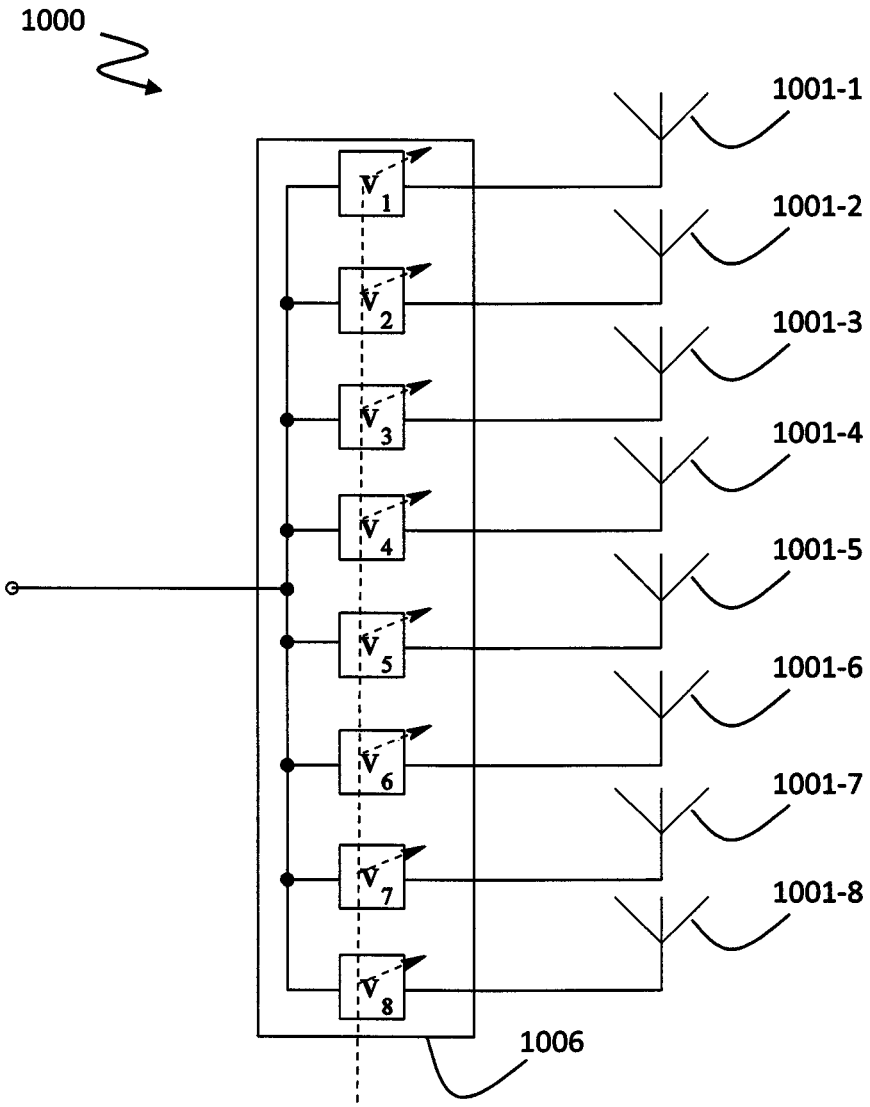
Fig. 1 Prior Art
FIG. 1 shows a prior art passive antenna array.
Figure 2:
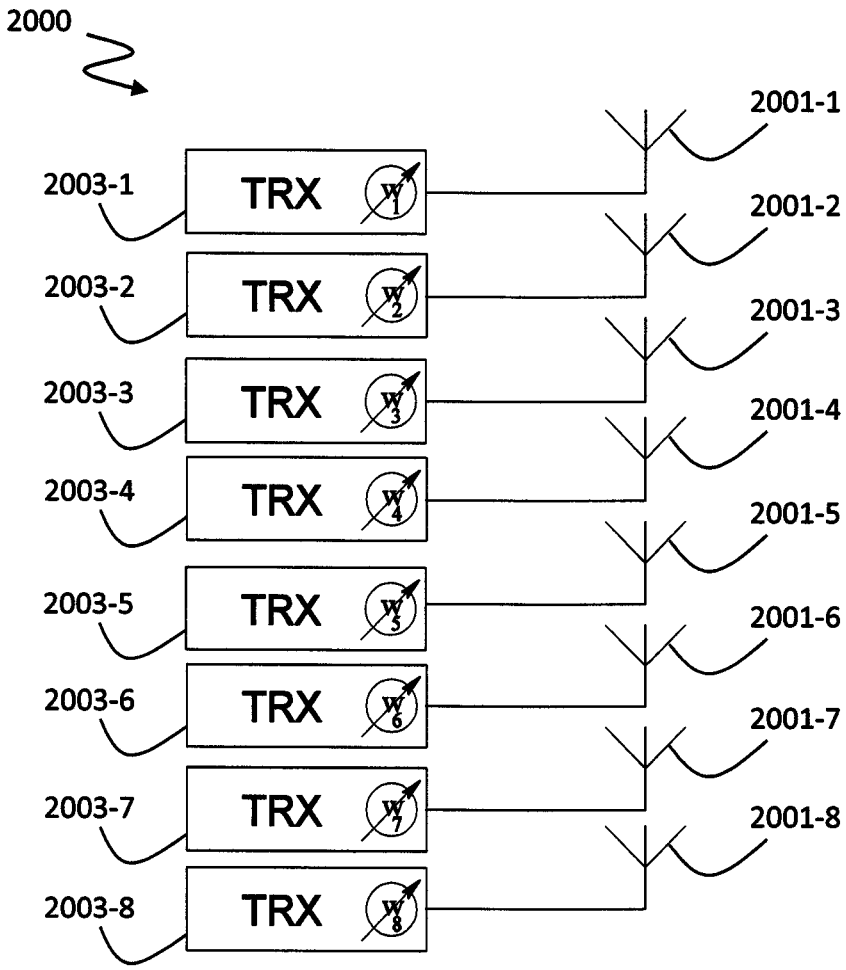
Fig. 2 Prior Art
FIG. 2 shows a prior art active antenna array.
Figure 3:
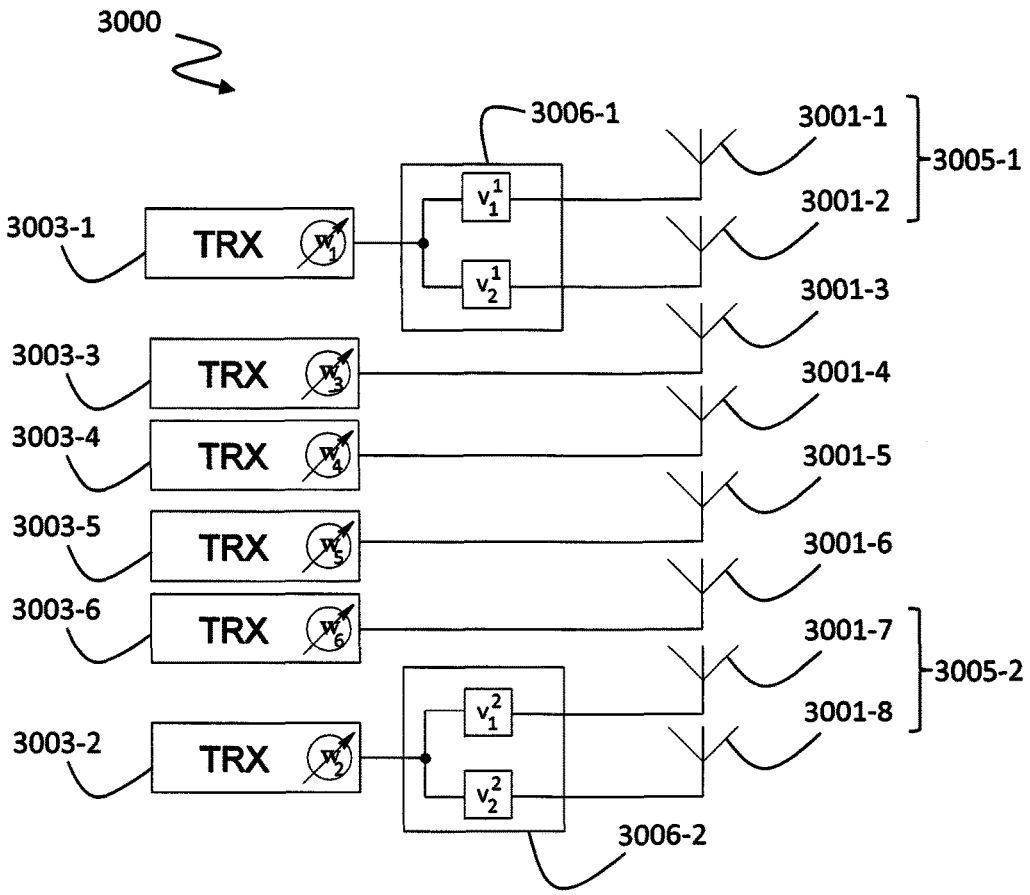
FIG. 3 shows an example of an active antenna array according to one aspect of the present disclosure.

FIG. 3 shows an example of an active antenna array 3000 according to an aspect of the present disclosure. The antenna array 3000 comprises a plurality of antenna elements 3001-1 through 3001-8 arranged in a vertical column. It should be noted that the present invention may be directed to an active antenna array 3000 with antenna elements 3001-1 through 3001-8 arranged in a vertical column, but is not restricted to such a vertical arrangement. The antenna elements 3000-1 through 3000-8 may be arranged linearly (i.e. with equal spacing) or non-linearly (i.e. with unequal spacing), vertically or horizontally, in a two- or multi-dimensional array, or in any other suited fashion. It should further be noted that the number of antenna elements 3000-1 through 3000-8 is not limited to eight. There may be any number N of antenna elements 3001-1 through 3001-N in the active antenna array 3000. In the example shown in FIG. 3, there is a central subset of four active antenna elements 3001-3 through 3001-6 of the plurality of antenna elements 3001-1 through 3001-8. It should be noted that the number of active antenna elements 3001-3 through 3001-6 in the subset is not limited to four. The active antenna element subset may comprise any number M of the plurality of N antenna elements 3001-1 through 3001-N, where M≤N−2. The active antenna array 3000 further comprises a plurality of six transceiver modules 3003-1 through 3003-6, of which the transceiver modules 3003-3 through 3003-6 are associated and actively coupled to the respective active antenna elements 3001-3 through 3001-6.

The active antenna array 3000 of FIG. 3 further comprises two passively combined sub-arrays 3005-1,2 of two antenna elements 3001-1,2 and 3001-7,8, respectively, of the plurality of antenna elements 3001-1 through 3001-8. A first one 3005-1 (an upper sub-array) of the two sub-arrays 3005-1,2 comprises the uppermost two antenna elements 3001-1,2, which are passively combined by a first passive feed network 3006-1. Analogously, a second one 3005-2 (a lower sub-array) of the two sub-arrays 3005-1,2 comprises the lowermost two antenna elements 3001-7, 3001-8, which are passively combined by a second passive feed network 3006-2. It should be noted that the active antenna array 3000 may alternatively comprise one or any other number K sub-arrays of N antenna elements 3001-1 through 3001-N, where K≤N/2. The sub-arrays 3005-1,2 may be located at the upper and lower end, respectively, of the vertical column of antenna elements 3001-1 through 3001-8, such that the active antenna element subset 3001-3 through 3001-6 is located between the sub-arrays 3005-1,2. This allows for a so-called "tapered" antenna array as will be described below. However, the at least one sub-array may be located at any suitable place in the active antenna array 3000. The active antenna array 3000 comprises two common transceiver modules 3003-1,2, which are associated to the upper sub-array 3005-1 and the lower sub-array 3005-2, respectively. The antenna elements 3001-1,2 of the upper sub-array 3005,1 are coupled to the common transceiver module 3003,1 associated to the upper sub-array 3005-1 and the antenna elements 3001-7,8 of the lower sub-array 3005,2 are coupled to the common transceiver module 3003,2 associated to the lower sub-array 3005-2. The number of common transceiver modules 3003-1 through 3003-K associated to the respective sub-arrays 3005-1 through 3005-K corresponds to the number K of sub-arrays 3005-1 through 3005-K of N antenna elements 3001-1 through 3001-N, where 1≤K≤N/2. In total, the number of transceiver modules 3003-1 through 3003-6, i.e. six in the example of FIG. 3, in the antenna array 3000 is smaller than the number of antenna elements 3001-1 through 3001-8, i.e. eight in the example of FIG. 3, in the antenna array 3000.

The first passive feed network 3006-1 connecting the upper sub-array 3005-1 with the common transceiver module 3003-1 associated to the upper sub-array 3005-1 may be adjusted by determining static phase relations $v_1^1$, $v_2^1$ for the antenna elements 3001-1,2 of the upper sub-array 3005-1. Such an adjustment of the upper sub-array 3005-1 may be performed by means of either mechanical tilting (e.g. using a stepper-motor or servo-motor based system for remotely moving the passive antenna's system tilt angle, by physically moving theof the upper sub-array 3005-1) or by means of a 'remote electrical tilt' (RET) system. The RET system typically utilizes motor-controlled phase shift elements to achieve a tilt of the beam formed from the radio signals. The phases and/or amplitudes of the antenna elements 3001-1,2 can thereby be progressively shifted in relation to each other in order to shape the beam of the antenna array 3000.

Analogously, the second passive feed network 3006-2 connecting the lower sub-array 3005-2 with the common transceiver module 3003-2 associated to the lower sub-array 3005-2 may be adjusted by determining static phase relations $v_1^2$, $v_2^2$ for the antenna elements 3001-7,8 of the lower sub-array 3005-2. Such an adjustment of the lower sub-array 3005-2 may be performed by means of either mechanical tilting or by means of a RET system, as described in the previous paragraph. The phases and/or amplitudes of the antenna elements 3001-7,8 can thereby be progressively shifted in relation to each other in order to shape the beam of the antenna array 3000.

The phases and/or amplitudes of the active antenna element subset 3001-3 through 3001-6 may be dynamically determined by beam forming parameters $w_3$ through $w_6$. The phases and/or amplitudes of the sub-arrays 3005-1,2 in relation to the active antenna element subset 3001-3 through 3001-6 may be dynamically determined by beam forming parameters $w_1$ and $w_2$, respectively.

Figure 4:
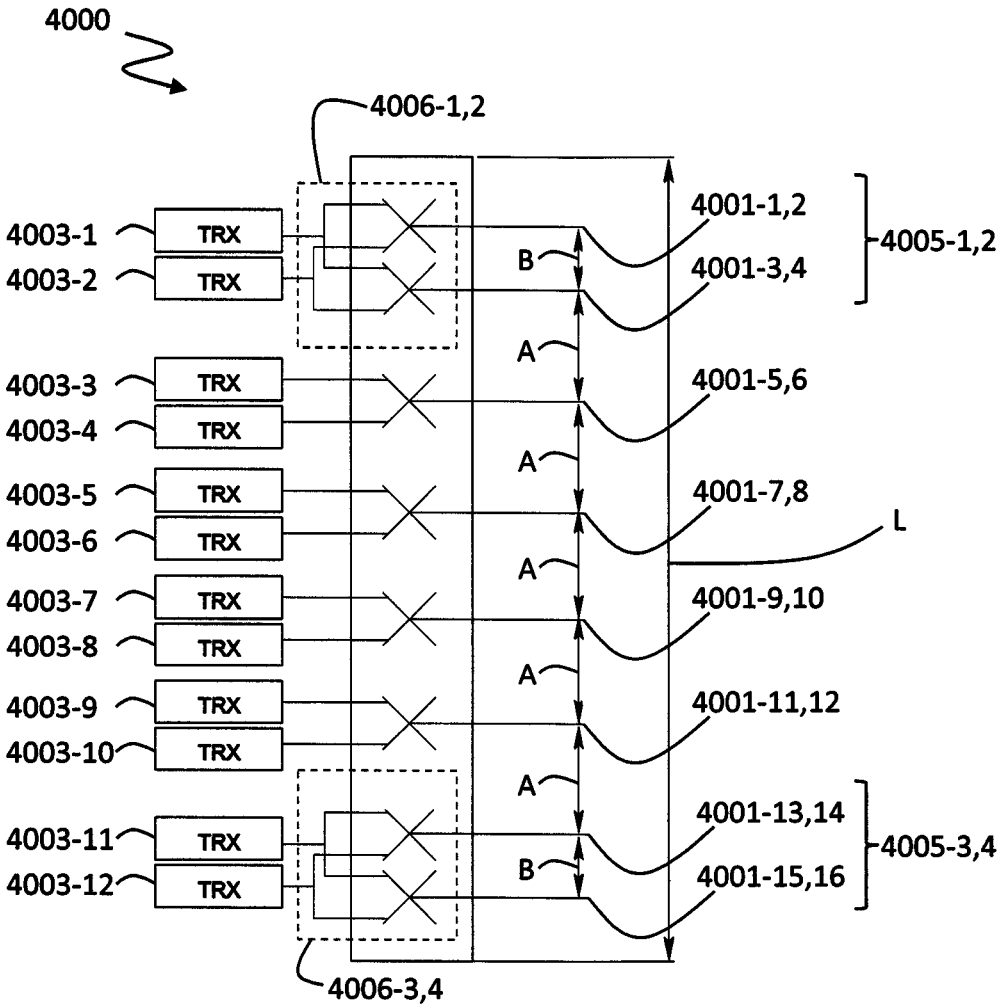
FIG. 4 shows another example of an active antenna array according to the present disclosure.

FIG. 4 shows another example of an antenna array 4000 according to the present invention, which is usable for the 700 MHz range, e.g. in the 3GPP operating bands No. 12 (Lower 700 MHz), No. 13 (Upper 700 MHz) and No. 14 (Upper 700 MHz, public safety/private). The vertical length of the antenna array lies in the order of 1800 mm (about 6 feet). The antenna array 4000 comprises a column of eight antenna elements 4001-1 through 4001-16 arranged in pairs in a vertical column, wherein every two adjacent antenna elements form a pair of mutually cross-polarized antenna elements. Even numbered antenna elements 4001-2, 4001-4, . . . , 4001-16 have a first polarization and odd numbered antenna elements 4001-1, 4001-3, . . . , 4001-15 have a second polarization, which differs from the first polarization. It should be noted that the antenna array 4000 could also be multidimensional and that the pairs of mutually cross-polarized antenna elements are not necessarily adjacent to each other or neighboring antenna elements.

In the example shown in FIG. 4, there is a central subset of four pairs of active antenna elements 4001-5 through 4001-12 of the plurality of antenna elements 4001-1 through 4001-16. It should be noted that the number of pairs of active antenna elements is not limited to four. The central active antenna element subset may comprise any number M of the plurality of N antenna elements 4001-1 through 4001-N, where $M \leq N-2$. The active antenna array 4000 further comprises a total of 12 transceiver modules 4003-1 through 4003-12, of which the central four pairs of transceiver modules 4003-3 through 4003-10 are associated and actively coupled to the respective central four pairs of the active antenna element subset 4001-5 through 4001-12.

The active antenna array 4000 of FIG. 4 further comprises two pairs of passively combined sub-arrays 4005-1 through 4005-4. Two antenna elements 4001-1,3 have the first polarization and two antenna elements 4001-2,4 have the second polarization. Similar the antenna elements 4001-13,15 have the first polarization and the antenna elements 4001-14,16 have the second polarization). The first sub-array 4005-1 comprises the uppermost two antenna elements 4001-1,3 having the first polarization, which are passively combined by a first passive feed network 4006-1. The second sub-array 4005-2 comprises the uppermost two antenna elements 4001-2,4 having the second polarization, which are passively combined by a second passive feed network 4006-2. Analogously, the third sub-array 4005-3 comprises the lowermost two antenna elements 4001-13,15 having the first polarization, which are passively combined by a third passive feed network 3006-3. The fourth sub-array 4005-4 comprises the lowermost two antenna elements 4001-14,16 having the second polarization, which are passively combined by a fourth passive feed network 4006-4.

It should be noted that the active antenna array 4000 may alternatively comprise one or any other number K sub-arrays of N antenna elements 4001-1 through 4001-N, where $K \leq N/2$. The sub-arrays 4005-1 through 4005-4 may be arranged such that there is one sub-array for each polarization located at the upper end and the lower end of the vertical column of antenna elements 4001-1 through 4001-16. The central active antenna element subset 4001-5 through 4001-12 is located between the sub-arrays 4005-1,2 and 4005-3,4. This allows for a so-called "tapered" antenna array as will be described below. However, the at least one central sub-array may be located at any suitable place in the active antenna array 4000. The active antenna array 4000 further comprises two pairs of common transceiver modules 4003-1,2, 11,12, which are associated to the upper sub-arrays 4005-1,2 and the lower sub-arrays 4005-3,4, respectively. The antenna elements 4001-1,3 of the first upper sub-array 4005,1 are coupled to the common transceiver module 4003,1 associated to the first upper sub-array 4005,1, the antenna elements 4001-2,4 of the second upper sub-array 4005,2 are coupled to the common transceiver module 4003,2 associated to the second upper sub-array 4005,2, the antenna elements 4001-13,15 of the first lower sub-array 4005,3 are coupled to the common transceiver module 4003,11 associated to the first lower sub-array 4005,3, and the antenna elements 4001-14, 16 of the second lower sub-array 4005,4 are coupled to the common transceiver module 4003,12 associated to the second lower sub-array 4005,4. The number of common transceiver modules 4003-1 through 4003-K associated to the sub-arrays 4005-1 through 4005-K corresponds to the number K of sub-arrays 4005-1 through 4005-K of N antenna elements 4001-1 through 4001-N, where $1 \leq K \leq N/2$. In total, the number of transceiver modules 4003-1 through 3003-12, i.e. twelve in the example of FIG. 4, in the antenna array 4000 is smaller than the number of antenna elements 4001-1 through 4001-16, i.e. sixteen in the example of FIG. 4, in the antenna array 4000.

The pairs of the active antenna element subset 4001-5 through 4001-12 have a non-limiting spacing A of about 250 mm. The same distance A of about 250 mm is chosen for the spacing between the active antenna element subset 4001-5 through 4001-12 and the sub-arrays 4005-1,2. However, the pairs of the antenna elements 4001-1 through 4001-4 of the upper first and second sub-array 4005-1,2 have a smaller non-limiting spacing B of about 140 mm. In a symmetric way, the pairs of the antenna elements 4001-13 through 4001-16 of the lower third and fourth sub-array 4005-3,4 have also a non-limiting spacing B of about 140 mm. Strictly speaking, the antenna array 4000 of FIG. 4 is therefore not a linear array, because the spacing is not the same between all of the antenna elements 4001-1 through 4001-16. However, in sum, the total length L of the antenna array is about 1800 mm (about 6 feet). Thereby, the eight pairs of the antenna elements 4001-1 through 4001-16 can be arranged within the same length L which houses an antenna array of only six pairs having a spacing of 300 mm. The unequal spacing of the antenna elements 4001-1 through 4001-4 and 4001-13 through 4001-16 of the sub-arrays 4005-1 through 4005-4 compared to the spacing of the central active antenna element subset 4001-5 through 4001-12, or compared to the spacing between the active antenna element subset 4001-5 through 4001-12 and the sub-arrays 4005-1,2, allows the synthesis of two sub-array patterns with a rather flat antenna diagram in the angular range which covers the tilt range of the overall antenna. In this way it is possible to maintain the full flexibility for beam tilting (in comparison to a six pair linear array) without significantly sacrificing antenna gain (see FIGS. 5*a* and 5*b*).

In comparison to a six pair linear antenna array, the eight pair non-linear antenna array 4000 shown in FIG. 4 provides a higher antenna gain and better side lobe suppression due to the higher number of the antenna elements 4001-1 to 4001-8. However, the length and costs of the active antenna array 4000 are not increased linearly with the increased number of the antenna elements 4001-1 to 4001-8. Since the passively combined sub-arrays 4005-1 through 4005-4 are used in the eight pair non-linear antenna array 4000, the total length L and the number of the transceiver modules can be the same as for a six pair linear array.

Figure 5A:
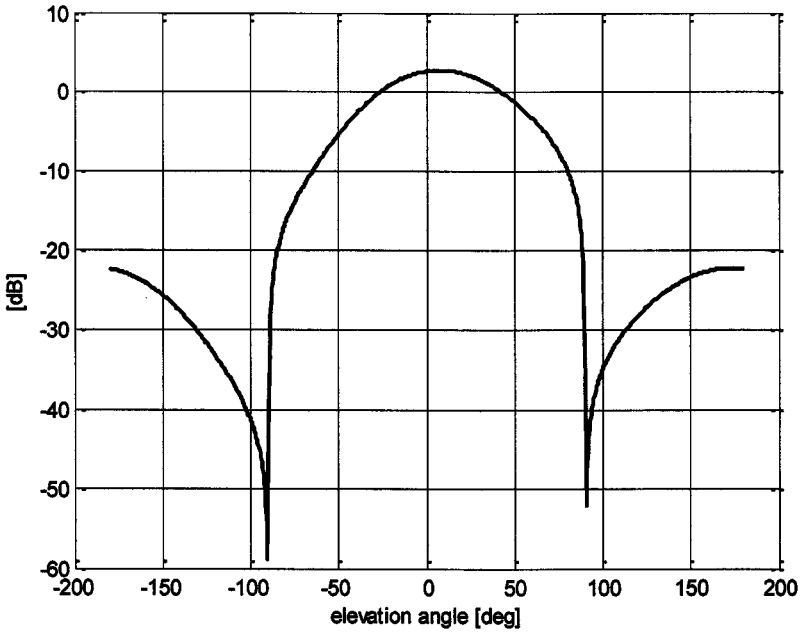
FIG. 5*a* shows an antenna pattern of a lower passively combined sub-array of the active antenna array depicted in FIG. 4.
Figure 5B:
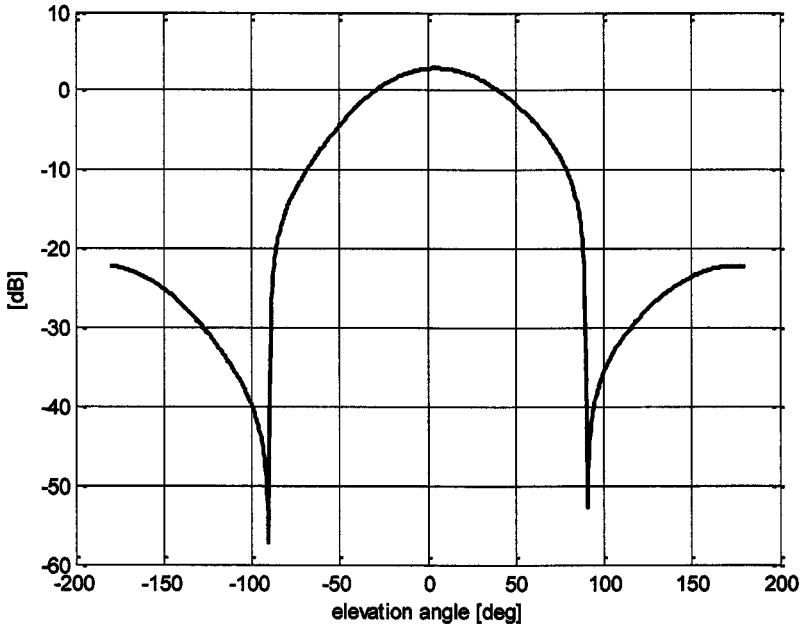
FIG. 5*b* shows an antenna pattern of an upper passively combined sub-array of the active antenna array depicted in FIG. 4.
Figure 6A:
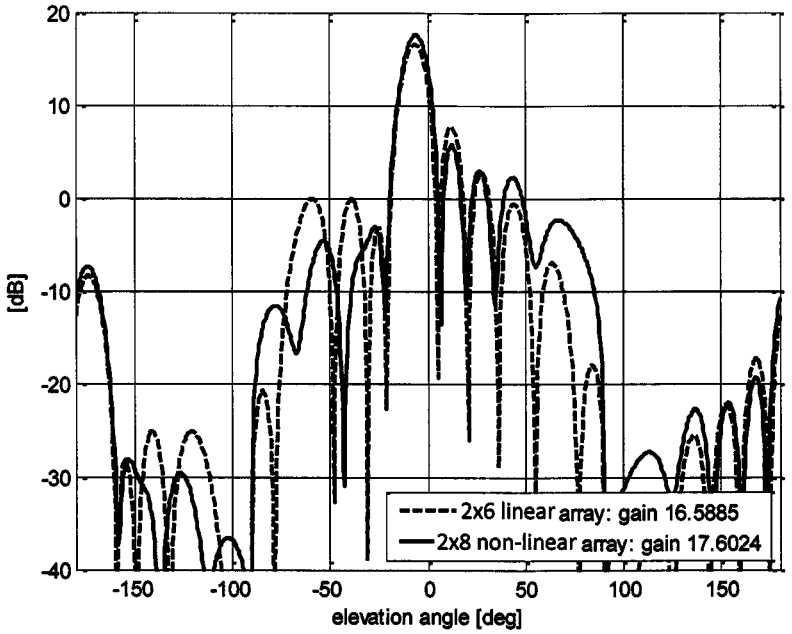
FIG. 6*a* shows an overall antenna pattern of the active antenna array depicted in FIG. 4 for a tilt angle of −6° in comparison with a standard 6-elements active antenna array.
Figure 6B:
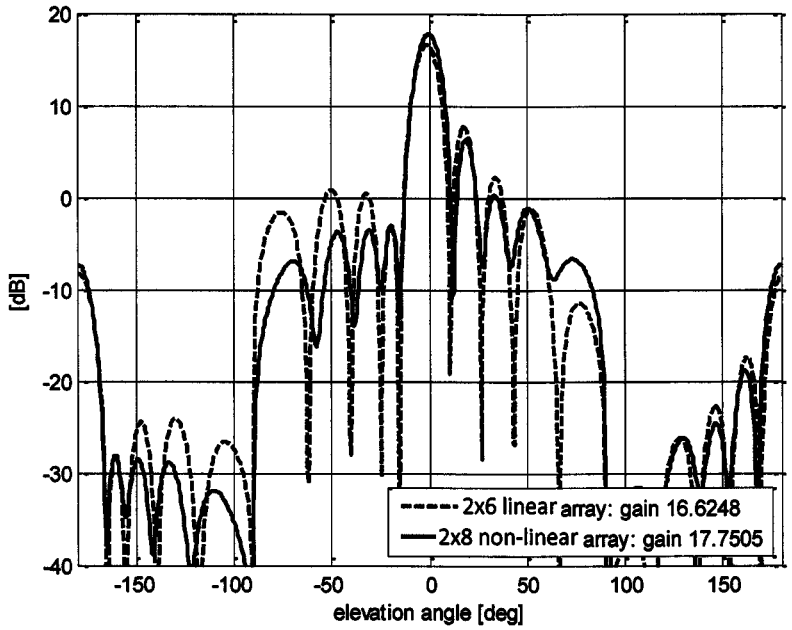
FIG. 6*b* shows an overall antenna pattern of the active antenna array depicted in FIG. 4 for a tilt angle of 0° in comparison with a standard 6-elements active antenna array.
Figure 6C:
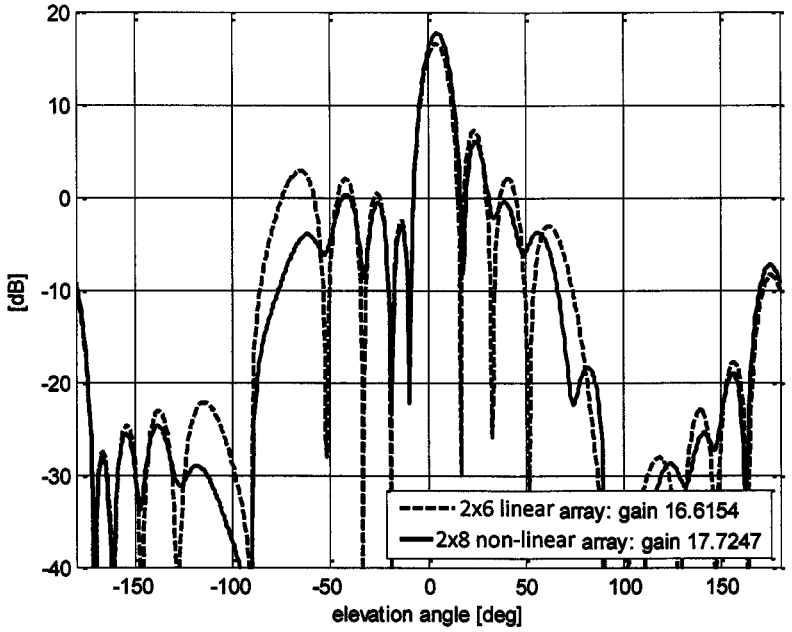
FIG. 6*c* shows an overall antenna pattern of the active antenna array depicted in FIG. 4 for a tilt angle of 6° in comparison with a standard 6-elements active antenna array.
Figure 6D:
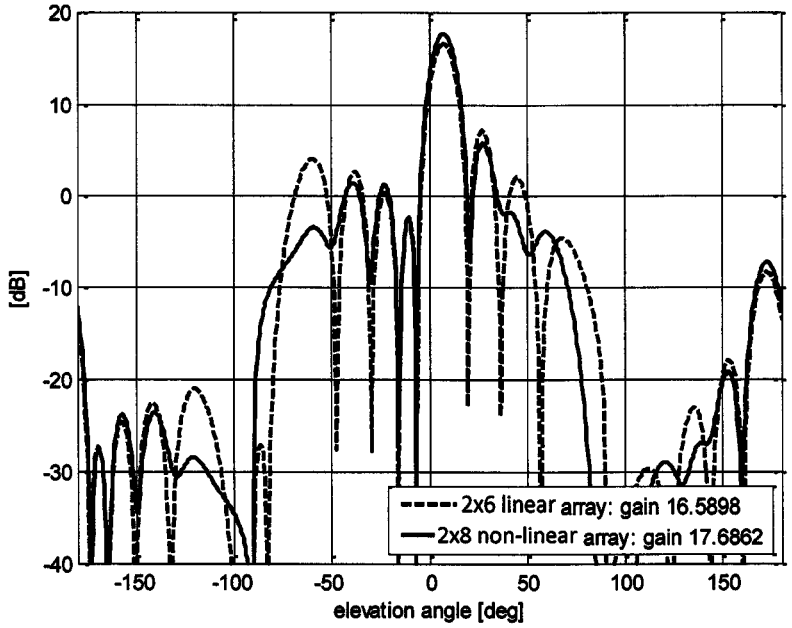
FIG. 6*d* shows an overall antenna pattern of the active antenna array depicted in FIG. 4 for a tilt angle of 9° in comparison with a standard 6-elements active antenna array.
Figure 6E:
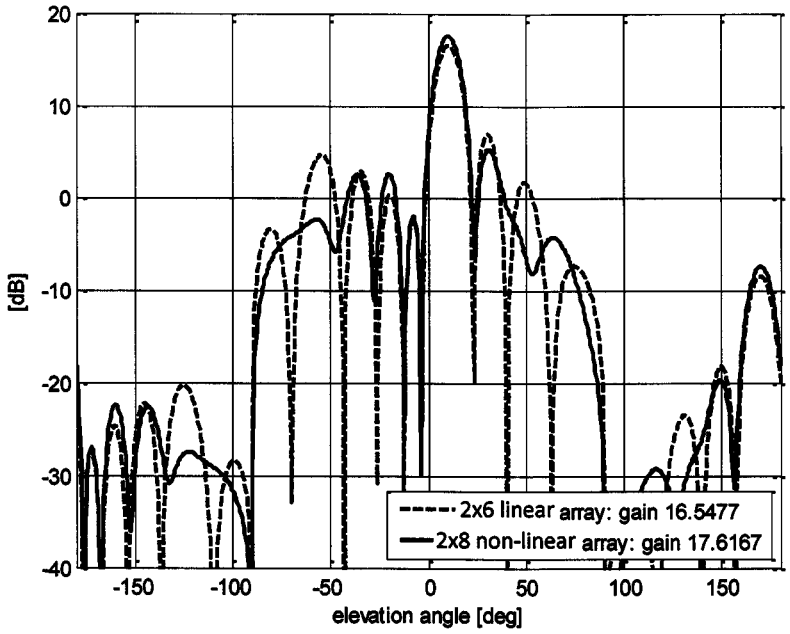
FIG. 6*e* shows an overall antenna pattern of the active antenna array depicted in FIG. 4 for a tilt angle of 12° in comparison with a standard 6-elements active antenna array.
Figure 6F:
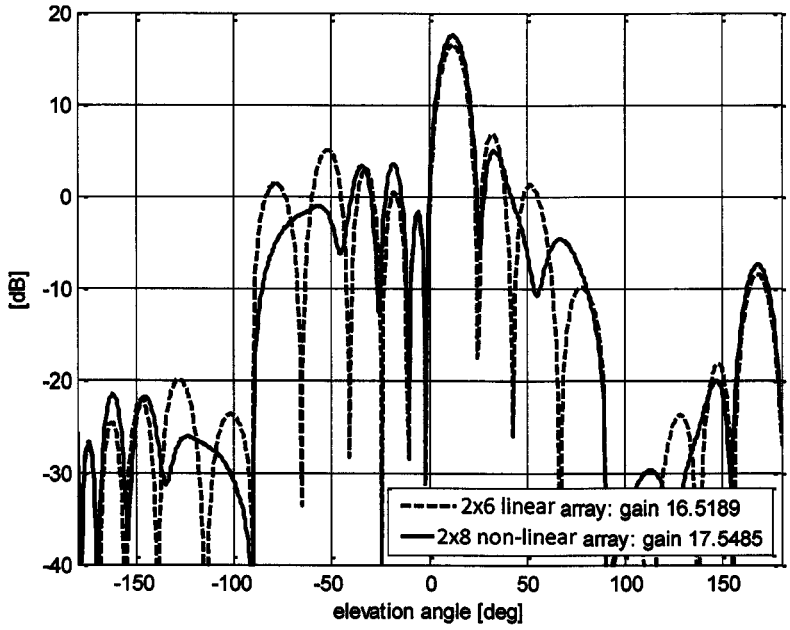
FIG. 6*f* shows an overall antenna pattern of the active antenna array depicted in FIG. 4 for a tilt angle of 14° in comparison with a standard 6-elements active antenna array.

FIG. 5*a* illustrates the antenna pattern of the lower sub-array 4005-3, 4005-4 over the elevation angle in degrees. Within the tilt range of the overall active antenna array 4000 (typically below 20°), the antenna pattern is relatively flat. This provides flexibility in beam tilting. A similarly flat antenna pattern of the upper sub-array 4005-1,2 is shown in FIG. 4 over the elevation angle in degrees. Using suitable optimization techniques, the two static phase relations $v_1^2$, $v_2^2$ for a bottom sub-array 4005-3,4 are complex weights and chosen to be $$v_1^2 = \sqrt{\frac{1}{3}}\exp(j\varphi_1),$$

$$v_2^2 = \sqrt{\frac{2}{3}}, \exp(j\varphi_1)$$

while the complex static phase relations $v_1^1$, $v_2^1$ for a top sub-array 4005-1,2 have been determined to be $$v_1^2 = \sqrt{\frac{2}{3}}\exp(j\varphi_2),$$

$$v_2^2 = \sqrt{\frac{1}{3}}, \exp(j\varphi_2)$$

whereby $\varphi_1$ and $\varphi_2$ represent the phase.

As can be understood from the formulae, for the top sub-array and the bottom sub-array 4005-1 through 4005-4, the amplitudes of the complex static phase relations $v_1^1$, $v_2^1$ and $v_1^2$, $v_2^2$, respectively, are not distributed equally between the two passively combined antenna elements. This allows the realization of a tapered antenna array pattern, which significantly provides a better side lobe suppression without significant compromises in performance. In contrast to that, with a six pair linear antenna array, tapering of the antenna array possible would only be possible by reducing signal power of the antenna elements situated at the ends of the linear antenna array. The reducing of the signal power, however, decreases the overall output power and therefore reduces overall power efficiency of the antenna array.

The present disclosure provides a solution for providing a tapered antenna array pattern without the need for different ones of the antenna elements having different output powers (which would increase system complexity, reduces total output power and reduces system efficiency), because static phase relations $v_1^1$, $v_2^1$ and $v_1^2$, $v_2^2$ between the antenna elements 4001-1 through 4001-4 and 4001-13 through 4001-16 of the passively combined sub-arrays 4005-1 through 4005-4 at the ends of the antenna array 4000 may be determined appropriately. It should be understood that a similarly tapered antenna array pattern can also be achieved with the antenna array 3000 shown in FIG. 3.

Once the static phase relations $v_1^1$, $v_2^1$ and $v_1^2$, $v_2^2$ for the sub-arrays have been determined, an overall pattern synthesis is possible by determining the complex beam forming weights $w_1$ through $w_{12}$ for each one of the transceiver modules 4003-1 to 4003-12 by applying suitable optimization techniques under the condition of the requirements regarding beam pattern shape and tilt angle. The complex beam forming weights $w_1$ through $w_{12}$ for the twelve transceiver modules 4003-1 to 4003-12 have to be chosen such that the superposition of the beam patterns of the sub-arrays 4005-1 through 4005-4 and active antenna elements 4001-5 through 4001-12 yields a desired overall beam pattern. The complex beam forming weights $w_1$ through $w_{12}$ can generally not simply be obtained by phase progression as it is commonly done for classical linear arrays, but the complex beam forming weights $w_1$ through $w_{12}$ have to be designed taking into account the beam patterns of the static sub-arrays 4005-1 through 4005-4, which cannot be modified dynamically during operation.

To obtain the static sub-array weights $v_1^i$, $v_2^i$ for each sub-array i as well as the adjustable beam forming weights $w_j$ for each the active transceiver modules j, synthesis techniques can be used, which are based on suitable optimization techniques. Generally, such optimization techniques may require non-linear objective functions or constrains. It turned out that optimization algorithms based on swarm optimization techniques and/or genetic algorithms (e.g. described in D. W. Boeringer, D. H. Werner, "*Particle Swarm Optimization Versus Genetic Algorithms for Phased Array Synthesis*", IEEE Transactions on Antennas And Propagation, Vol. 52, No. 3, March 2004) are well suited for such purposes.

Using optimization algorithms based on swarm optimization and genetic algorithms, the overall antenna patterns depicted in FIGS. 6*a-f* are obtained for the tilt angles −6°, 0°, 6°, 9°, 12° and 14°. The antenna pattern of the eight pair non-linear antenna array 4000 of FIG. 4 is shown in a solid line compared to an antenna pattern of a six pair linear array (dotted line) with the same length of about 1800 mm (about 6 feet). From these figures, it can be observed that the antenna gain for all of the elevation angles −6°, 0°, 6°, 9°, 12° and 14° has a higher gain than the six pair linear array by more than one dB in the main lobe direction. Furthermore, the eight pair non-linear antenna array 4000 has a better suppression of the first upper side lobe for all of the elevation angles −6°, 0°, 6°, 9°, 12° and 14°.

Figure 7:
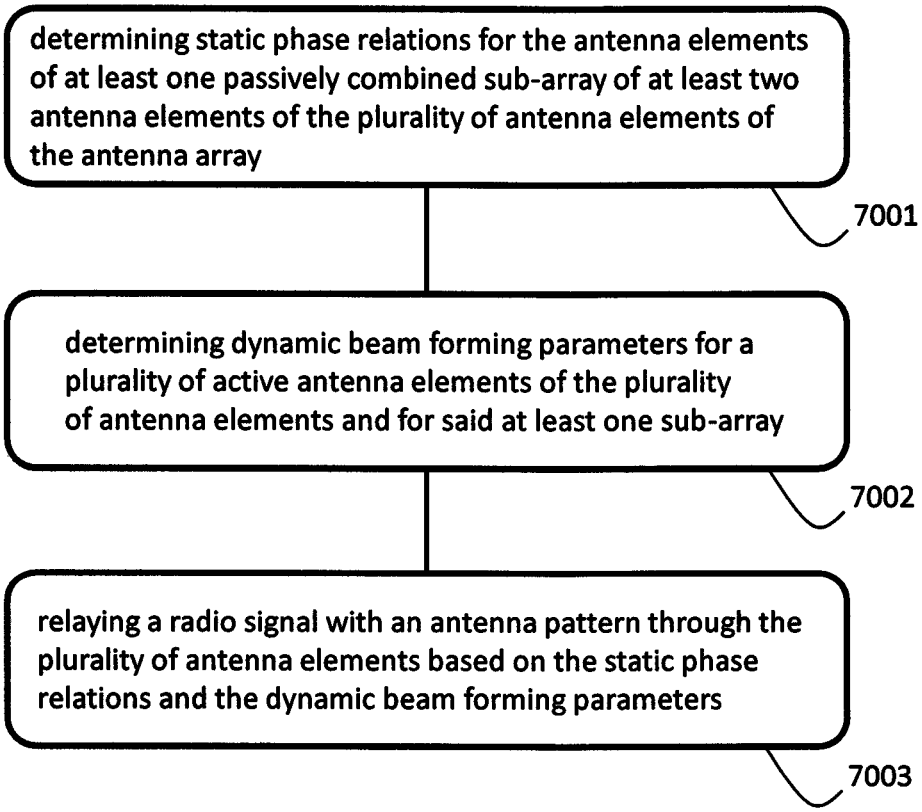
FIG. 7 shows an example of a method for generating antenna patterns according to the present invention.

FIG. 7 shows an example of a method for generating antenna patterns with an antenna array having a plurality of antenna elements according to the present invention. A first determining step 7001 of the method comprises determining static phase relations $v_1^i$ through $v^i_{K^i}$, for the $K^i$ antenna elements of each i of M passively combined sub-arrays of $K^i$ antenna elements of the plurality of N antenna elements of the antenna array, where $$\sum_{i=1}^{M} K^i \leq N - 1$$

and M≤N/2. A second determining step 7002 comprises determining a dynamic beam forming parameter $w_1$ through $w_j$ for each j of a subset of n active antenna elements of the plurality of N antenna elements and for each i of said M sub-arrays, where n+M=J≤N−1. A third determining step 7003 comprises relaying a radio signal with an antenna pattern through the plurality of N antenna elements based on the static phase relations $v_1^i$ through $v^i_{K^i}$ and the dynamic beam forming parameters $w_1$ through $w_J$. It should be noted that the second determining step 7002 may be performed before, after, or simultaneously with respect to the first determining step 7001. It is, however, advantageous for the calculations using optimization algorithms based on swarm optimization techniques and/or genetic algorithms to determine the static phase relations $v_1^i$ through $v^i_{K^i}$ before the dynamic beam forming parameters $w_1$ through $w_J$. The second determining step 7002 may be based on the first determining step 7001.

The static phase relations $v_1^i$ through $v^i_{K^i}$ are complex weights and the dynamic beam forming parameters $w_1$ through $w_J$ are complex weights. The method may comprise a further step of determining static amplitude relations for the $K^i$ antenna elements of each i of M passively combined sub-arrays of $K^i$ antenna elements of the plurality of N antenna elements of the antenna array. In order to achieve a tapering effect without reducing overall relay power, the static amplitude relations are unequally distributed among the $K^i$ antenna elements of a sub-array i. The determining step 7001 may therefore include determining static phase relations for the at least two uppermost antenna elements of a vertical column of the plurality of antenna elements of the antenna array, wherein one of said sub-arrays comprises the at least two uppermost antenna elements. Symmetrically, the determining step 7002 may include determining static phase relations for the at least two lowermost antenna elements of the vertical column, wherein another one of said sub-arrays comprises the at least two lowermost antenna elements.

The determining steps 7001 and/or 7002 may use optimization algorithms based on swarm optimization techniques and/or genetic algorithms, which may be performed under the condition that the variety of beam forming parameters that do not significantly restrict the flexibility in antenna patterns, in particular beam forming or tilt range, is maximized. The determining steps 7001 and/or 7002 may be alternatively or additionally performed under the condition that the variety of beam forming parameters that do not significantly restrict the flexibility in beam forming or tilt range is maximized.

To achieve an antenna pattern that comes closest to a desired antenna pattern, the determining steps 7001 and/or 7002 may be iteratively repeated. However, the second determining step 7002 may be performed dynamically at any time during operation of the antenna array or at an idle state of the antenna array, whereas the first determining step 7001 may only performed during an idle state of the antenna array.

While various embodiments of the present invention have been described above, it should be understood that they have been presented by way of example, and not limitation. It will be apparent to persons skilled in the relevant arts that various changes in form and detail can be made therein without departing from the scope of the invention. In addition to using hardware (e.g., within or coupled to a central processing unit ("CPU"), micro processor, micro controller, digital signal processor, processor core, system on chip ("SOC") or any other device), implementations may also be embodied in software (e.g. computer readable code, program code, and/or instructions disposed in any form, such as source, object or machine language) disposed for example in a computer useable (e.g. readable) medium configured to store the software. Such software can enable, for example, the function, fabrication, modelling, simulation, description and/or testing of the apparatus and methods describe herein. For example, this can be accomplished through the use of general program languages (e.g., C, C++), hardware description languages (HDL) including Verilog HDL, VHDL, and so on, or other available programs. Such software can be disposed in any known computer useable medium such as semiconductor, magnetic disc, or optical disc (e.g., CD-ROM, DVD-ROM, etc.). The software can also be disposed as a computer data signal embodied in a computer useable (e.g. readable) transmission medium (e.g., carrier wave or any other medium including digital, optical, analogue-based medium). Embodiments of the present invention may include methods of providing the apparatus described herein by providing software describing the apparatus and subsequently transmitting the software as a computer data signal over a communication network including the internet and intranets.

It is understood that the apparatus and method describe herein may be included in a semiconductor intellectual property core, such as a micro processor core (e.g., embodied in HDL) and transformed to hardware in the production of integrated circuits. Additionally, the apparatus and methods described herein may be embodied as a combination of hardware and software. Thus, the present invention should not be limited by any of the above-described exemplary embodiments, but should be defined only in accordance with the following claims and their equivalents.

The invention claimed is:

1. An antenna array having a plurality of antenna elements vertically arranged in a vertical column comprising:

a plurality of transceiver modules;

an active antenna element subset of the plurality of antenna elements, wherein the active antenna element subset comprises at least one active antenna element, the at least one active antenna element being actively coupled to its own subset transceiver module of the plurality of transceiver modules, wherein at least one of phases and amplitudes of the at least one active antenna element of the active antenna element subset may be dynamically determined by beam forming parameters; and at least one passively combined sub-array of at least two antenna elements of the plurality of antenna elements, wherein said at least one passively combined sub-array is actively coupled to an associated sub-array transceiver module of the plurality of transceiver modules, wherein the at least two antenna elements are passively combined by a passive feed network, the passive feed network being adjusted by determining static phase relations between the at least two antenna elements of the at least one passively combined subarray and wherein the passive feed network is coupled actively to a common sub-array transceiver module of the plurality of transceiver modules, wherein at least one of phases and amplitudes of said at least one passively combined sub-array may be dynamically determined by beam forming parameters, and wherein the active antenna element subset and the at least one passively combined sub-array are arranged in said vertical column.

2. The antenna array of claim 1, comprising at least two passively combined sub-arrays, wherein the active antenna element subset is located between said at least two passively combined sub-arrays.

3. The antenna array of claim 1, wherein the at least two antenna elements of said at least one passively combined sub-array have a smaller spacing between individual ones of the at least two antenna elements than the spacing between an active antenna element in the active antenna element subset and an antenna element in said at least one passively combined sub-array.

4. The antenna array of claim 1, wherein the number of transceiver modules in the plurality of transceiver modules is smaller than the number of antenna elements in the plurality of antenna elements.

5. The antenna array of claim 1, wherein the antenna elements are arranged in a single vertical column.

6. The antenna array of claim 1, wherein the active antenna element subset and the at least one passively combined sub-array are arranged one below the other in the single vertical column.

7. The antenna array of claim 1, wherein the single vertical column comprises a predefined number of horizontal lines, wherein there is only one antenna element per line.

8. A computer program product embodied on a non-transitory computer-readable medium and the computer-readable medium comprising executable instructions for the manufacture of an antenna array having a plurality of antenna elements vertically arranged in a vertical column, the antenna array comprising:

a plurality of transceiver modules;

an active antenna element subset of the plurality of antenna elements, wherein the active antenna element subset comprises at least one active antenna element, the at least one active antenna element being actively coupled to its own subset transceiver module of the plurality of transceiver modules, wherein at least one of phases and amplitudes of said at least one active antenna element may be dynamically determined by beam forming parameters; and at least one passively combined sub-array of at least two antenna elements of the plurality of antenna elements, wherein said at least one passively combined sub-array is actively coupled to an associated sub-array transceiver module of the plurality of transceiver modules, wherein the at least two antenna elements are passively combined by a passive feed network, the passive feed network being adjusted by determining static phase relations between the at least two antenna elements of the at least one passively combined subarray and wherein the passive feed network is coupled actively to a common sub-array transceiver module of the plurality of transceiver modules wherein at least one of phases and amplitudes of said at least one passively combined sub-array may be dynamically determined by beam forming parameters, and wherein the active antenna element subset and the at least one passively combined sub-array are arranged in said vertical column.

* * * * *